US005497903A

United States Patent [19]

Yoneyama

[11] Patent Number: 5,497,903

[45] Date of Patent: Mar. 12, 1996

[54] MULTIPLE FOLDED PAPER FOR CONTINUOUS DISPOSAL

[76] Inventor: Katsu Yoneyama, 413 Mitojima, Fuji-shi, Shizuoka-ken, Japan

[21] Appl. No.: 372,313

[22] Filed: Jan. 13, 1995

[30] Foreign Application Priority Data

Jan. 26, 1994 [JP] Japan ..... 6-023774

[51] Int. Cl.[6] ..... A47K 10/24

[52] U.S. Cl. ..... 221/48; 206/812

[58] Field of Search ..... 221/47, 48, 50, 221/33; 206/812, 554

[56] References Cited

U.S. PATENT DOCUMENTS 3,207,360 9/1965 Scott ..... 221/48

5,219,092 6/1993 Morand ..... 221/48

*Primary Examiner*—Kenneth Noland

*Attorney, Agent, or Firm*—Wenderoth, Lind & Ponack

[57] ABSTRACT

A multiple folded paper for continuous disposal comprising a container; a first group of sheets of paper folded rightwardly; and a second group of sheets of paper folded leftwardly; a lower folded-section of each of the first group sheets of paper being interdigitated with an upper folded-section of each of the second group sheets of paper thereunder, thereby forming a multiple folded paper; the multiple folded paper being received in the container such that a leading end of the upper folded-section, which is in a frictional engagement at the interdigitated area with the uppermost folded sheet of paper, is exposed out of the outlet slit by drawing out the upper folded-section of the uppermost folded sheet of paper through an outlet slit formed in the container, thereby facilitating a continuous disposal of the multiple folded paper; wherein a tail end of the lower folded-section of each of the first group sheets of paper folded rightwardly and a tail end of the lower folded-section of each of the second group sheets of paper are folded back in an opposite direction with respect to the folding direction of each sheet of paper, thereby forming superimposing ends of a reduced width respectively, the reduced width superimposing end of each of the rightwardly folded sheets of paper being interdigitated with the leading end of the upper folded-section of each of the leftwardly folded sheets of paper.

4 Claims, 4 Drawing Sheets

MULTIPLE FOLDED PAPER FOR CONTINUOUS DISPOSAL

BACKGROUND OF THE INVENTION

1. Field of the Invention

This invention relates to a multiple folded paper for continuous disposal, in which the multiple folded paper is received in a container such that it can be gradually pulled out of the container through an outlet slit formed in the container, in a continuous way.

2. Brief Description of the Prior Art

Generally, multiple folded paper such as wet paper tissue, dry paper tissue, paper towel and the like is received in a container so that it can be pulled out through an outlet slit formed in the container, in a continuous way. Examples of such multiple folded paper are shown in FIGS. 1 to 5. Those examples of the conventional multiple folded paper are of a common construction in that the lower folded-sections 1*a* (or 2*a*) of rightwardly folded sheets of paper 1 (or leftwardly folded sheets of paper 2) and the upper folded-sections 2*b* (or 1*b*) of leftwardly folded sheets of paper 2 (or rightwardly folded sheets of paper 1) are interdigitated with each other, thereby forming a multiple folded paper, and the multiple folded paper is received in a container 3 such that the leading ends of the upper folded-sections 1*b* or 2*b* of the lower folded sheets of paper, which are in a frictional engagement at the interdigitated areas with the upper folded sheets of paper, are exposed out of the outlet slit by drawing out the upper folded-section 1*b* or 2*b* of the uppermost folded sheet of paper 1 or 2 through an outlet slit 3*a* formed in the top of the container 3, thereby facilitating a continuous disposal of the multiple folded paper.

The multiple folded paper shown in FIGS. 1 and 2 are most widely used. The multiple folded paper 4 shown in FIG. 1 is constructed by folding respective sheets of paper having a predetermined size into two such that one parts having generally a half size are interdigitated with the other parts. Therefore, the folded-section having generally a half size of each folded sheet of paper 1 or 2 is exposed out of the outlet slit 3*a* of the container 3.

The multiple folded paper 4 shown in FIG. 2 is constructed by folding respective sheets of paper 1 and 2 having a predetermined size into the form of Z, so that the lower folded-sections are interdigitated with the folded-sections of other folded sheets of paper. Therefore, the folded-section having generally one third size of the folded sheets of paper 1 and 2 are exposed out of the outlet slit 3*a* of the container 3.

In any one of the examples of multiple folded paper 4 shown in FIGS. 1 and 2, about a half or a third of the folded sheets of paper 1, 2 of a predetermined size are exposed out of the outlet slit 3*a*. It is pointed out that the exposed parts of the folded sheets of paper 1, 2 are so excessively long as to adversely affect the sense of beauty.

Especially, in case the multiple folded paper 4 is a wet paper tissue wetted by chemical solution or the like, there is the shortcoming in that the folded-section of each folded sheet of paper is adhered by the chemical solution over a considerable length dimension from its end and therefore, the next following folded sheet of paper to the folded sheet of paper to be pulled out of the outlet slit 3*a* is totally drawn out of the outlet slit 3*a* together with the folded sheet of paper to be pulled out. Moreover, in the case of a wet paper tissue, that part of the folded sheet of paper which is exposed out of the outlet slit is dried to lose its effectiveness.

Therefore, it is desired that the exposed part of the folded sheet of paper is made as short as possible. The examples shown in FIGS. 1 and 2 have the shortcoming in that the exposed parts are too long. The examples of FIGS. 1 and 2 are difficult to be applied to wet paper tissue because of the above-mentioned two reasons. Also, in the case of dry paper tissue and dry paper towel, there are likewise the shortcomings in that the exposed part is too long and the sense of beauty is adversely affected.

As shown in FIGS. 3A and 4A, it is contemplated to make the interdigitating area of each folded sheet of paper 1, 2 as short as possible by appropriately adjusting the folding position of the sheet of paper 1, 2. However, in the case of the example of FIG. 3A, since the interdigitating areas are one-sided to the right-half side or left-half side of the multiple folded paper 4 as shown in FIG. 3B, there is the shortcoming in that one side becomes bulky.

In the example of FIG. 4A, since the interdigitating areas are concentrated on the intermediate portion of the multiple folded paper as shown in FIG. 4B, there is the shortcoming in that the intermediate portion is swollen. Therefore, in any one of FIGS. 3 and 4, there are the problems that when a plurality of multiple folded paper 4 are stacked up, they are liable to fall down or collapse, and that the multiple folded paper 4, which becomes locally bulky, loses the value of merchandise.

Also, as shown in FIG. 5, it is contemplated, in order to prevent the multiple folded paper 4 from becoming locally bulky, to proportionally distributing the interdigitating areas of the folded sheets of paper to the right-half side and left-half side of the multiple folded paper by appropriately adjusting the folding position of the double folded sheets of paper 1, 2.

Although this technique can prevent the multiple folded paper from becoming locally bulky, it involves the problem that the widths of the upper folded-sections 1*b*, 2*b* of the double folded sheets of paper become longer to the extent of the reduced parts of the lower folded-sections 1*a*, 2*a* and as a result, the width of the container is considerably increased compared with the example of FIG. 1, thus making it difficult to practice.

Also in the example of FIG. 5, there is another problem in that the exposed parts or amounts of the upper folded-sections 1*b* and 2*b* of the folded sheets of paper 1 and 2 reach generally a third of the folded sheets of paper as in the example of FIG. 2.

SUMMARY OF THE INVENTION

It is, therefore, an object of the present invention to provide a multiple folded paper for continuous disposal, in which an exposed length dimension of an upper folded-section of each folded sheet of paper is made as short as possible, interdigitating area of each folded sheet of paper is not locally concentrated in the multiple folded paper so that the problem to totally draw the lower folded sheet of paper together with the folded sheet of paper pulled out of an outlet slit of a container, thus enabling to advantageously apply this invention to a wet paper tissue and the like.

To achieve the above object, there is essentially provided a multiple folded paper for continuous disposal comprising a container; a first group of sheets of paper folded rightwardly; and a second group of sheets of paper folded leftwardly; a lower folded-section of each of the first group sheets of paper being interdigitated with an upper folded-section of each of the second group sheets of paper thereunder, thereby forming a multiple folded paper; the multiple folded paper being received in the container such that a leading end of the upper folded-section, which is in a frictional engagement at the interdigitated area with the uppermost folded sheet of paper, is exposed out of the outlet slit by drawing out the upper folded-section of the uppermost folded sheet of paper through an outlet slit formed in the container, thereby facilitating a continuous disposal of said multiple folded paper; wherein a tail end of the lower folded-section of each of the first group sheets of paper folded rightwardly and a tail end of the lower folded-section of each of the second group sheets of paper are folded back in an opposite direction with respect to the folding direction of each sheet of paper, thereby forming superimposing ends of a reduced width respectively, the reduced width superimposing end of each of the rightwardly folded sheets of paper being interdigitated with the leading end of the upper folded-section of each of the leftwardly folded sheets of paper and the reduced width superimposing end of each of the leftwardly folded sheets of paper being interdigitated with the leading end of the upper folded-section of each of the rightwardly folded sheets of paper, so that the reduced width superimposing ends of the rightwardly folded sheets of paper and the reduced width superimposing ends of the leftwardly folded sheets of paper will be proportionally distributed to the right side and the left side of the multiple folded paper.

In one preferred embodiment, the tail ends of the lower folded-sections of the rightwardly and leftwardly folded sheets of paper are folded back toward outer surfaces of basal portions of the lower folded-sections, thereby forming the reduced width superimposing ends, respectively. The tail ends of the lower folded-sections of the rightwardly and leftwardly folded sheets of paper may be folded back toward inner surfaces of basal portions of the lower folded-sections, thereby forming the reduced width superimposing ends, respectively. The folded sheets of paper may be wet paper tissue.

According to the present invention, the tail end of the lower folded-section of each folded sheet of paper is folded back to form the superimposing end of a reduced width for superimposition. Accordingly, the dimension of the interdigitating area between the folded sheets of paper can be reduced to about a quarter of the length of development of the folded sheet of paper. As a result, the length dimension of the upper folded-section exposed out of the outlet slit in the container can be reduced to about a quarter maximum due to the frictional engagement at the interdigitating area.

This multiple folded paper is not of the construction that the tail end of the lower folded-section of each folded sheet of paper is superimposed in a normal direction on a tail end of a folded sheet of paper to be drawn out of the outlet slit next.

Therefore, it can be prevented the inconvenience in that the lower folded sheet of paper is overly drawn out of the outlet slit in the container due to the tail end of the upper folded sheet of paper adhered to the tail end of the lower folded sheet of paper by static electricity, liquid or the like.

Also, according to the present invention, since the interdigitating areas having a reduced dimension can be proportionally distributed to the right side and left side of the multiple folded paper, the problem for making the multiple folded paper become locally bulky can also be solved.

As mentioned above, according to the present invention, the length dimension of the interdigitating area of each folded sheet of paper can be reduced and the tail end of the rightwardly folded sheet of paper can be avoided from being adhered to the tail end of the leftwardly folded sheet of paper in a normal direction with respect to a tensile force. Accordingly, even in the case where the folded sheets of paper are wet paper tissue, the problem for drawing the lower folded sheet of paper together with the upper folded sheet of paper can be obviated effectively.

The above and other objects and attendant advantages of the present invention will be apparent to those skilled in the art from a reading of the following description and claims in conjunction with the accompanying drawings which constitute part of this specification.

BRIEF DESCRIPTION OF THE DRAWINGS

FIG. 3 shows a third example of the prior art.

FIG. 4(A) is a schematic cross-sectional view of a multiple folded paper received in a container, and FIG. 4(B) is a side view showing the multiple folded paper being locally bulky;

DETAILED DESCRIPTION OF THE EMBODIMENTS

Several preferred embodiments of the present invention will now be described in detail with reference to FIGS. 6 to 10 inclusive. The preferred embodiments herein described are not intended to be exhaustive or to limit the invention to the precise form disclosed. They are chosen and described to explain the principles of the invention, its application and its practical use to enable others skilled in the art to utilize the invention.

Figure 1:
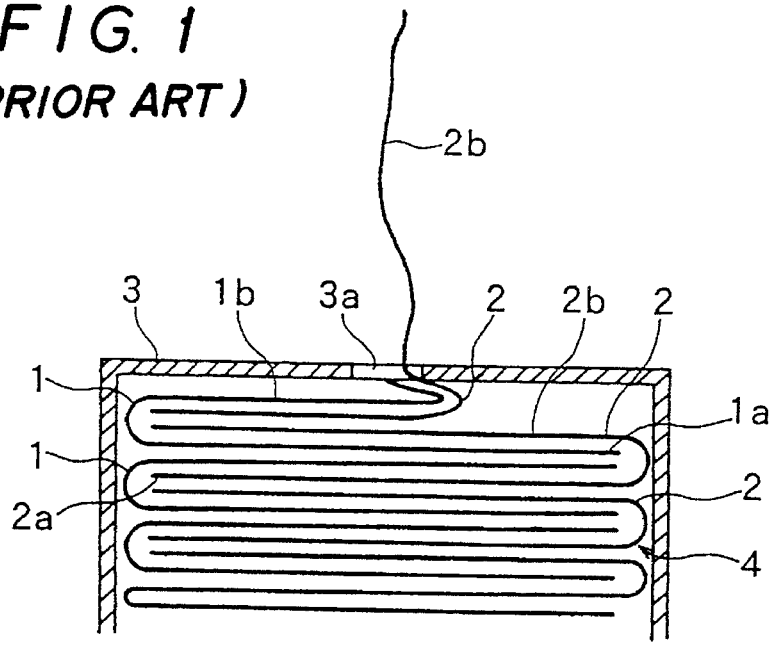
FIG. 1 (PRIOR ART)
FIG. 1 is a schematic cross-sectional view of a first example of the prior art, in which a multiple folded paper is received in a container.
Figure 2:
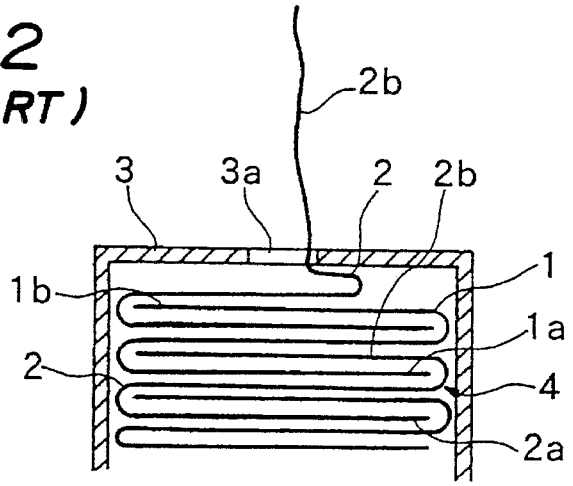
FIG. 2 (PRIOR ART)
FIG. 2 is likewise a schematic cross-sectional view of a second example of the prior art, in which a multiple folded paper is received in a container.
Figure 3A:
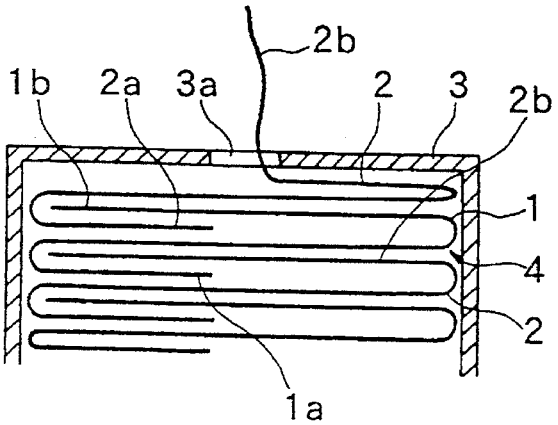
FIG. 3(A) (PRIOR ART)
FIG. 3(A) is a schematic cross-sectional view of a multiple folded paper received in a container.
Figure 3B:
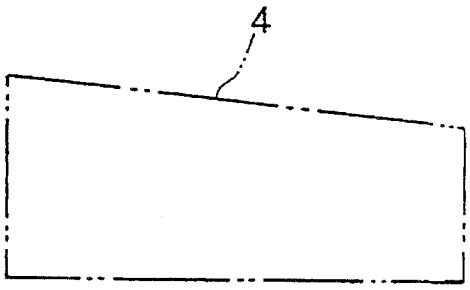
FIG. 3(B) (PRIOR ART)
FIG. 3(B) is a side view showing the multiple folded paper being locally bulky.
Figure 4:
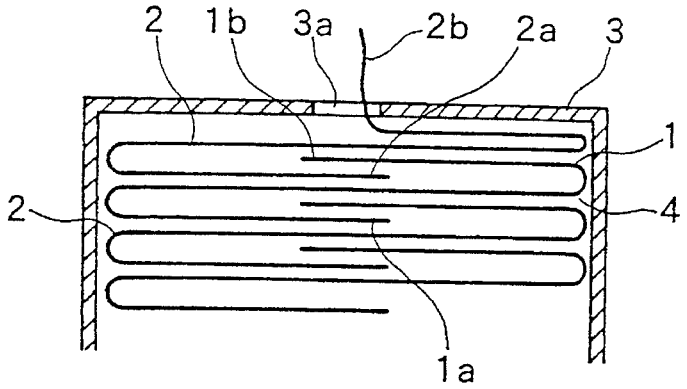
FIG. 4 (A) (PRIOR ART)
FIG. 4 shows a fourth example of the prior art.
Figure 4:
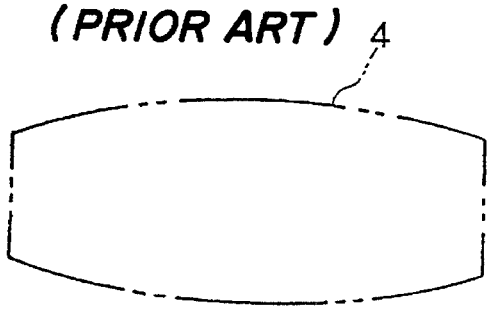
FIG. 4 (B) (PRIOR ART)
Figure 5:
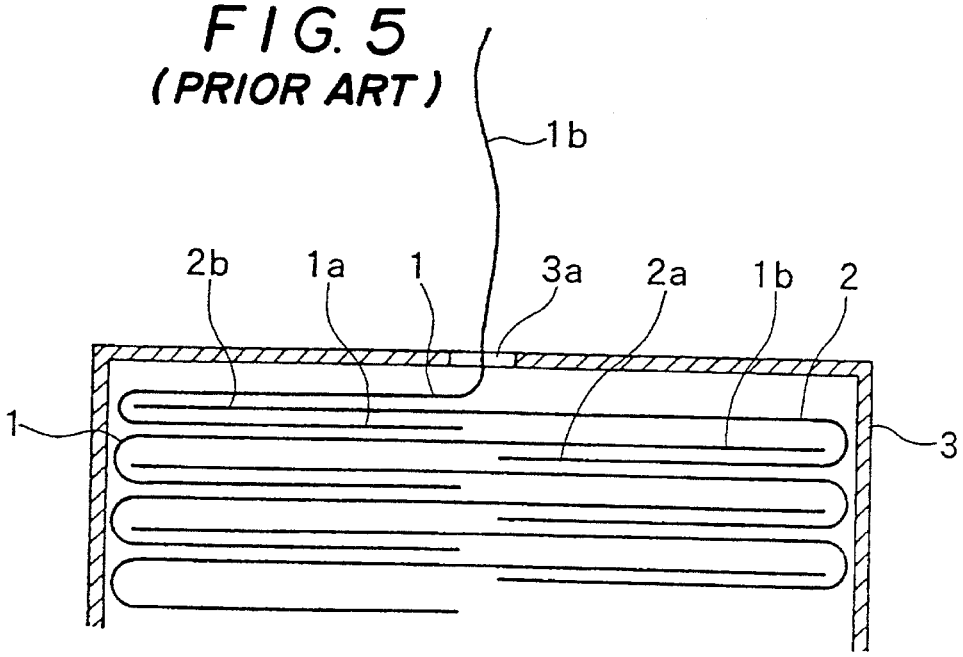
FIG. 5 (PRIOR ART)
FIG. 5 is a schematic cross-sectional view of a fifth example of the prior art, in which a multiple folded paper is received in a container.
Figure 6:
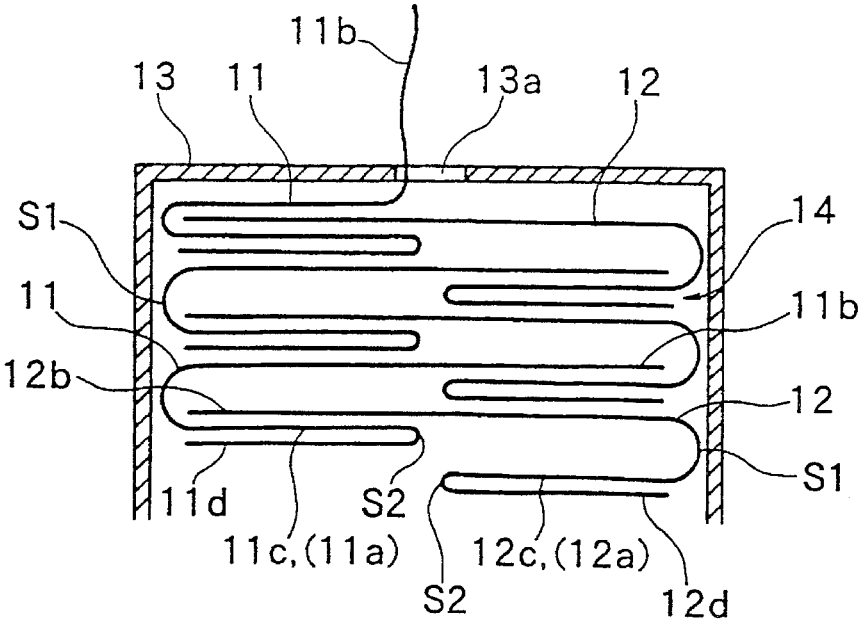
FIG. 6 is a schematic cross-sectional view of a first embodiment of the present invention, in which a multiple folded paper is received in a container.
Figure 8:
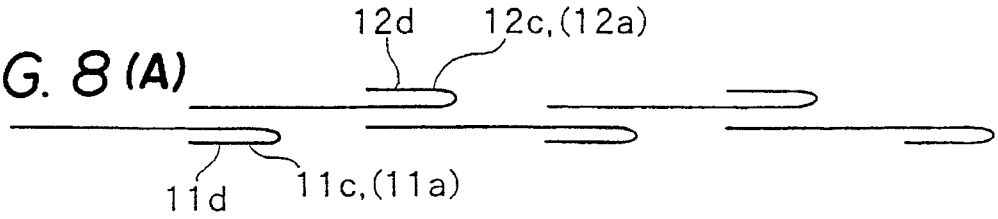
FIG. 8 is a schematic side view exemplifying a method for setting up the multiple folded paper according to the first embodiment of the present invention.
Figure 8:
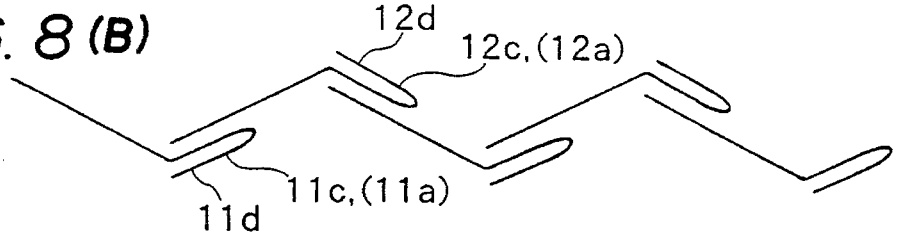

FIG. 6 shows a first embodiment of a multiple folded paper 14 according to the present invention, and FIG. 8 is a schematic side view exemplifying a method for setting up the multiple folded paper 14.

Figure 7:
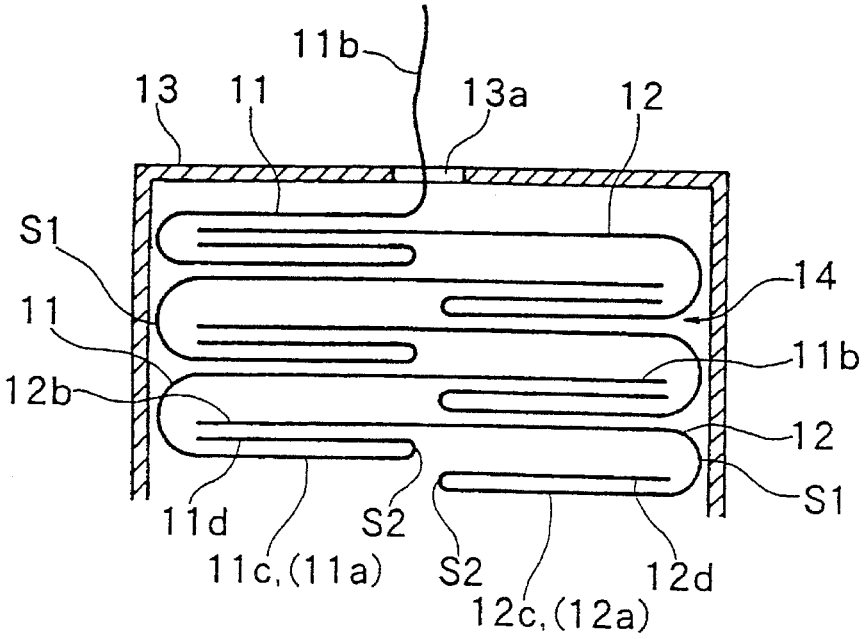
FIG. 7 is likewise a schematic cross-sectional view of a sectional view of a second embodiment of the present invention, in which a multiple folded paper is received in a container.
Figure 9:
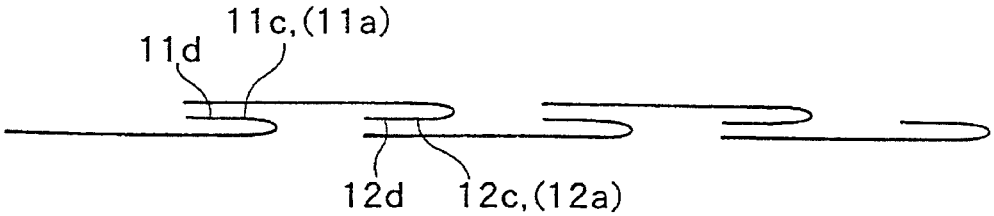
FIG. 9 is a schematic side view exemplifying a method for setting up the multiple folded paper according to the second embodiment of the present invention.
Figure 9:
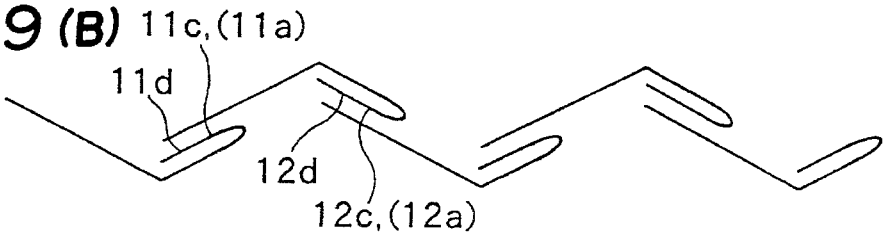
Figure 10:
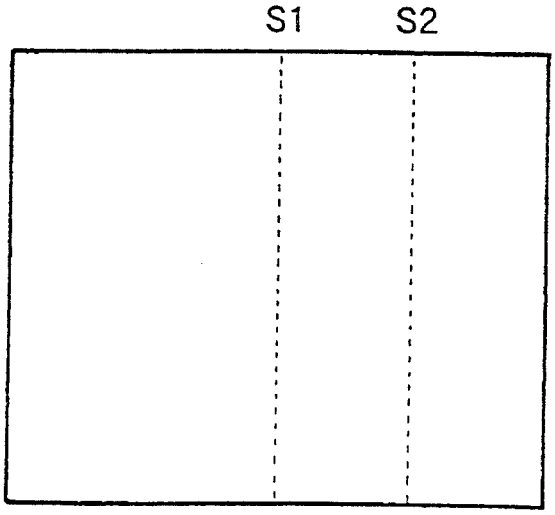
FIG. 10 is a plan view showing a development of a folded sheet of paper.

FIG. 7 shows a second embodiment of a multiple folded paper 14 according to the present invention, FIG. 9 is a schematic side view exemplifying a method for setting up the multiple folded paper 14, and FIG. 10 is a plan view showing the folding positions common to each folded sheet of paper.

As shown in FIGS. 6 and 7, the multiple folded paper 14 comprises rightwardly folded sheets of paper 11 and leftwardly folded sheets of paper 12 alternately superimposed, with lower folded-sections 11*a* (or 12*a*) of the rightwardly folded individual sheets of paper 11 (or 12) and upper folded-sections 12*b* (or 116*b*) of the leftwardly folded individual sheets of paper 12 (or 11) being interdigitated with each other.

In other words, the individual folded sheets of paper 11 (or 12) are folded such that the inner surface of the upper folded-section 12*b* (or 11*b*) each leftwardly folded sheet of paper 12 (or each rightwardly folded sheet of paper 11) is superimposed on the inner surface of the lower folded-section 11*a* (or 11*b*) of each superjacent rightwardly folded sheet of paper 11 (or each subjacent leftwardly folded sheet of paper 12). The terms "interdigitated" used herein refers to this arrangement.

The expression "rightwardly folded sheet of paper 11" refers to a sheet of paper having a folding line S1 on the left side and being open rightwardly. Similarly, the expression "leftwardly folded sheet of paper 12" refers to a sheet of paper having a folding line S1 on the right side and being open leftwardly.

Tail ends of the lower folded-sections 11*a* and 12*a* of the rightwardly and leftwardly folded sheets of paper 11 and 12 are folded back in an opposite direction with respect to the folding direction of each folded sheet of paper, thereby forming superimposing ends 11*c* and 12*c* of a reduced width respectively. The reduced width superimposing end 11*c* of the rightwardly folded sheet of paper 11 is interdigitated with the leading end of the upper folded-section 12*b* of each leftwardly folded sheet of paper 12. Similarly, the reduced width superimposing end 12*c* of each leftwardly folded sheet of paper 12 is interdigitated with the leading end of the upper folded-section 11*b* of each rightwardly folded sheet of paper 11. The arrangement being such that the reduced width superimposing ends 11*c* of the rightwardly folded sheets of paper 11 and the reduced width superimposing ends 12*c* of the leftwardly folded sheets of paper 12 are proportionally distributed to the right-half side and the left-half side of the multiple folded paper 14.

In the embodiment shown in FIG. 6, the tail ends of the lower folded-sections 11*a* and 12*a* of the rightwardly and leftwardly folded sheets of paper 11 and 12 are folded back toward outer surfaces of basal portions of the lower folded-sections. thereby forming the reduced width superimposing ends 11*c* and 12*c*, respectively.

In the embodiment shown in FIG. 7, the tail ends of the lower folded-sections 11*a* and 12*a* of the rightwardly and leftwardly folded sheets of paper 11 and 12 are folded back toward inner surfaces of basal portions of the lower folded-sections, thereby forming the reduced width superimposing ends 11*c* and 12*c*, respectively.

For setting up the multiple folded paper shown in FIGS. 6 and 7, firstly, a distal end portion of each sheet of paper is folded outwardly or inwardly by a length dimension equal to about a quarter of the overall length of the sheet of paper, thereby forming the reduced width superimposing ends 11*c* and 12*c*. The reduced width superimposing ends 11*c* and 12*c* thus formed correspond to the lower folded-sections 11*a* and 12*a*, respectively. Reference numerals 11*d* and 12*d* denote folded back sections, respectively.

Then, as shown in FIGS. 8(A) and 9(A), the reduced width superimposing ends 11*c* and 12*c* are superimposed with the tail end of a preceding sheet of paper. Then, as shown in FIGS. 8(B) and 9(B), the sheet of paper is folded at the end portion of the area where the reduced width superimposing ends 11*c* and 12*c* are superimposed with the tail end of the preceding sheet of paper, thereby obtaining the multiple folded paper shown in FIGS. 6 and 7.

FIG. 10 shows a development of the respective folded sheets of paper 11 and 12. Reference symbol S1 denotes a folding line, and S2 denotes a folding line for folding back the lower folded-sections 11*a* and 12*a*. As illustrated, the folding line S1 is set to position for dividing a sheet of paper having a predetermined length dimension into two generally equal parts, and the other folding line S2 is set to position for further dividing the lower folded-sections 11*a* and 12*a* into two generally equal parts. Accordingly, the sections 11*d* and 12*d* folded back by the folding line S2 have a length dimension generally a quarter of the length dimension of the development of the folded sheets of paper 11 and 12.

The multiple folded paper 14 thus formed is received in a container 13 such that a leading end of the upper folded-section 12*b* or 11*b* of the lower folded sheet of paper 12 or 11, which is in a frictional engagement at the interdigitated area with the uppermost folded sheet of paper 11 or 12, is exposed out of an outlet slit 13*a* formed in the top of the container 13 by drawing out the upper folded-section 11*b* or 12*b* of the uppermost folded sheet of paper 11 or 12 through the outlet slit 13*a*, thereby facilitating a continuous disposal of the multiple folded paper.

As will be understood from the superimposed state at the reduced width superimposing ends 11*c* and 12*c* shown in FIGS. 6 and 7, none of the multiple folded paper has the construction in which the upper folded sheet of paper overly draws out the lower folded sheet of paper.

Namely, the multiple folded paper 14 of FIG. 6 is of the construction in that a lower tail end of the upper folded sheet of paper and the lower end of the lower folded sheet of paper are not adhered to each other, thereby eliminating the cause for overly drawing out the lower folded sheet of paper together with the preceding sheet of paper. In other words, the reduced width superimposing end 11*c* formed by the lower folded-section 11*a* of the upper folded sheet of paper 11, for example, is not adhered to the upper folded-section 12*b* of the lower folded sheet of paper 12.

The reduced width superimposing end 11*c* of the upper folded sheet of paper 11 is merely superimposed at the basal end thereof with the leading end of the upper folded section 12*b* of the lower folded sheet of paper 12. Therefore, the cause for overly drawing out the lower folded sheet of paper together with the preceding sheet of paper caused by the arrangement allowing the superimposition of the tail ends of the upper and lower folded sheets of paper.

Although the multiple folded paper shown in FIG. 7 is of the construction in which the folded back sections 11*d* and 12*d* of the reduced width superimposing ends 11*c* and 12*c* are superimposed with the leading end of the upper folded section of the lower folded sheet of paper, this superimposition is clearly different in construction from the superimposition shown in FIGS. 1 to 5. That is, the folded back sections 11*d* and 12*d* are not interdigitated with the leading ends of the upper folded sections 11*b* and 12*b* of the lower folded sheet of paper. In other words, the folded back sections 11*d* and 12*d* are not superimposed with the leading ends of the upper folded sections 11*b* and 12*b* of the lower folded sheet of paper in such a way as to face in the opposite directions but they are superimposed in such a way as to face in the same direction. Accordingly, the tensile force acts on the folded back sections 11*d* and 12*d* as a peel-off force at the time the upper folded sheet of paper is pulled out. As a result, there can be obviated the inconvenience that the overall lower folded sheet of paper is drawn out together with the upper folded sheet of paper when the latter is pulled out. The above multiple folded paper 14 can be used for home-use paper tissue boxes, paper towel boxes, etc., and is particularly effective as a multiple folded paper for a wet paper tissue which is impregnated with a sterilization liquid.

According to the present invention, the dimension of the interdigitating area between the folded sheets of paper can be reduced to about a quarter of the length of the development of each folded sheet of paper by forming the reduced width superimposing ends. As a result, the dimension of the upper folded-section of each folded sheet of paper exposed out of the outlet slit of the container can be reduced to about a quarter maximum by the frictional engagement at the interdigitating area.

Also, the multiple folded paper provided with the reduced width superimposing ends is not of the construction in which the tail end of the lower folded-section of each folded sheet of paper prevails a tensile force directly to the tail end of the upper folded-section of the folded sheet of paper which is to be drawn out next.

Accordingly, there can be very effectively obviated the inconvenience in that the overall lower folded sheet of paper is overly drawn out of the outlet slit of the container due to the tail end of the upper folded sheet of paper adhered to the tail end of the lower folded sheet of paper by static electricity, liquid or the like.

Moreover, according to the present invention, since the interdigitating areas having a reduced dimension can be proportionally distributed to the right side and left side of the multiple folded paper, the problems for making the multiple folded paper become locally bulky, losing the value of merchandise and falling down a stack of multiple folded paper during a stacking operation can also be solved.

Furthermore, according to the present invention, since the harmful adhesion of the folded sheets of paper at the lower tail ends can be avoided, there can be effectively obviated the problem inherent in the multiple folded paper having wet paper tissue as the folded sheets of paper, in that the lower folded sheet of paper is overly drawn out together with the upper folded sheet of paper during the pulling out operation of the upper folded sheet of paper and as a result, the sterilization liquid impregnated therein is dried to lose its effectiveness.

Although this invention has been described in its preferred form with a certain degree of particularity, it is understood that the present disclosure of the preferred form has been made only by way of example and that numerous changes in the details of construction and arrangement of parts may be resorted to without departing from the spirit and the scope of the invention as hereinafter claimed.

What is claimed is:

1. A multiple folded paper for continuous disposal, comprising:

a container;

a first group of sheets of paper folded rightwardly; and a second group of sheets of paper folded leftwardly;

a lower folded-section of each of said first group sheets of paper being interdigitated with an upper folded-section of each of said second group sheets of paper thereunder, thereby forming a multiple folded paper;

said multiple folded paper being received in said container such that a leading end of the upper folded-section, which is in a frictional engagement at the interdigitated area with the uppermost folded sheet of paper, is exposed out of said outlet slit by drawing out the upper folded-section of the uppermost folded sheet of paper through an outlet slit formed in said container, thereby facilitating a continuous disposal of said multiple folded paper;

wherein a tail end of the lower folded-section of each of said first group sheets of paper folded rightwardly and a tail end of the lower folded-section of each of said second group sheets of paper are folded back in an opposite direction with respect to the folding direction of each sheet of paper, thereby forming superimposing ends of a reduced width respectively, the reduced width superimposing end of each of said rightwardly folded sheets of paper being interdigitated with the leading end of said upper folded-section of each of said leftwardly folded sheets of paper and the reduced width superimposing end of each of said leftwardly folded sheets of paper being interdigitated with the leading end of said upper folded-section of each of said rightwardly folded sheets of paper, so that the reduced width superimposing ends of said rightwardly folded sheets of paper and the reduced width superimposing ends of said leftwardly folded sheets of paper will be proportionally distributed to the right side and the left side of said multiple folded paper.

2. A multiple folded paper for continuous disposal as defined in claim 1, in which the tail ends of said lower folded-sections of said rightwardly and leftwardly folded sheets of paper are folded back toward outer surfaces of basal portions of said lower folded-sections, thereby forming said reduced width superimposing ends, respectively.

3. A multiple folded paper for continuous disposal as defined in claim 1, in which the tail ends of said lower folded-sections of said rightwardly and leftwardly folded sheets of paper are folded back toward inner surfaces of basal portions of said lower folded-sections, thereby forming said reduced width superimposing ends, respectively.

4. A multiple folded paper for continuous disposal as defined in claim 1, in which said folded sheets of paper are wet paper tissue.

* * * * *